US005473520A

United States Patent [19]

Malley

[11] Patent Number: 5,473,520

[45] Date of Patent: Dec. 5, 1995

[54] FLASHLIGHT HOLDING MOUTHPIECE

[76] Inventor: Kirk J. Malley, 2070 Fox Way, Concord, Calif. 94518

[21] Appl. No.: 282,809

[22] Filed: Jul. 29, 1994

[51] Int. Cl.[6] ..... F21L 15/08

[52] U.S. Cl. ..... 362/190; 362/103

[58] Field of Search ..... 362/103, 108, 362/109, 157, 190, 191, 208, 807, 23; 128/777

[56] References Cited

U.S. PATENT DOCUMENTS

| | | | |
|---|---|---|---|
| 1,844,588 | 2/1932 | Meitzler | 128/23 |
| 2,299,467 | 10/1942 | Colby | 362/190 |
| 5,124,898 | 6/1992 | Chabria | 362/205 |
| 5,226,712 | 7/1993 | Lucas | 362/190 |

*Primary Examiner*—Ira S. Lazarus
*Assistant Examiner*—Y. Quach
*Attorney, Agent, or Firm*—Schapp and Hatch

[57] ABSTRACT

A flashlight holding mouthpiece which consists of a receptacle portion adapted to grippingly embrace the rear end of an associated miniature flashlight and an outwardly projecting flange portion, the entire mouthpiece, including the receptacle portion and the flange portion, being a unitary body of resilient material. In a first embodiment of the invention the flange portion is small enough to be received between the user's teeth and lips. In the second preferred embodiment the flange portion is large enough to project the user's lips from coming in contact with the metal barrel of the miniature flashlight.

4 Claims, 2 Drawing Sheets

FLASHLIGHT HOLDING MOUTHPIECE

BACKGROUND OF THE INVENTION

1. Field of the Invention

My present invention relates to flashlights, and more particularly to flashlight holding mouthpieces for use by persons who hold miniature flashlights in their mouths while working.

2. Description of the Prior Art

Flashlight holding mouthpieces are well known in the prior art.

U.S. Pat. No. 3,418,461, issued to Stephen P. Sedlock on Dec. 24, 1968, discloses a flashlight with supporting clamp.

In the device of Sedlock a C-type clamp is conformably but detachably and adjustably connectible with the capped end of the barrel of a conventional-type flashlight. An invertible L-shaped dual purpose support bracket has one leg fixed to a median part of the clamp. The other leg is provided with a rubber sleeve fashioned into a conventionally grippable comfortably shaped mouthpiece. A spring jaw clip is fixed to an end portion of the C-clamp. The clip can be clipped to a shirt pocket, windshield visor or elsewhere for support. With the C-clamp facing up the capped end can be caused to be rest against the user's forehead. Facing down and clamped the flashlight can be located beneath the user's chin.

As seen in Sedlock, the flashlight supporting clamp thereof is comprised of a number of rigid, mechanical parts which are affixed to each other in such manner as to be immovable with respect to each other. Thus, the device of Sedlock is bulky and complex, and is not well adapted for carrying in the user's pocket, especially the user's shirt pocket.

U.S. Pat. No. 5,074,295, issued to James J. Willis on Dec. 24, 1991, discloses a mouth-held implement holder which is adapted for the support of a flashlight.

The mouth-held implement holder disclosed in Willis has a socket at one end which receives the butt end of the implement. The opposite end of the holder is formed as a mouthpiece. The mouthpiece being inserted into the mouth is gripped by the molars, which extend along the sides of the upper and lower jaws of the user.

The mouth-held implement holder of Willis is almost as long as the flashlight supported thereby, and the major side-to-side dimension thereof is almost twice as great as the diameter of the flashlight barrel.

Further, the device of Willis is provided with a pair of rings 64, 66 to which a head strap is secured in some embodiments.

Thus, it will be seen that the device of Willis is by no means compact and thus conveniently carryable in the user's pockets, such as the pockets of a policeman's blouse.

U.S. Pat. No. Des. 302,334, issued to Orlando DeGuevara on Jul. 18, 1989, discloses a mouth supported holder for flashlights.

The mouth supported holder for flashlights of DeGuevara is comprised of a socket adapted to receive the butt end of a flashlight and a mouth-grippable projection or blade extending axially from said socket.

The mouth supported holder of DeGuevara, and more particularly the mouth-grippable blade thereof, clearly extends the length of the associated flashlight, and also considerably increases the width thereof.

It is believed that the patents listed immediately below contain information which is or might be considered to be material to the examination of this application.

U.S. Pat. No. 3,225,982

U.S. Pat. No. 4,114,187

U.S. Pat. No. 4,112,936

U.S. Pat. No. 4,664,109

U.S. Pat. No. 5,063,483

U.S. Pat. No. DES.332,500

The term "prior art" as used herein or in any statement made by or on behalf of applicant means only that any document or thing referred to as prior art bears, directly or inferentially, a date which is earlier than the effective filing date hereof.

No representation or admission is made that any of the above-listed documents is part of the prior art, or that no more pertinent information exists.

A copy of each of the patents referred to hereinabove is supplied to the United States Patent and Trademark Office herewith.

SUMMARY OF THE INVENTION

Accordingly, it is an object of my present invention to provide flashlight holding mouthpieces which are more compact than the flashlight holding mouthpieces of the prior art, and thus can conveniently be carried when not in use.

Another object of my present invention is to provide flashlight holding mouthpieces which can be carried in the user's pocket or other small receptacle along with other personal items of daily use.

Yet another object of my present invention is to provide flashlight holding mouthpieces which can be kept on a flashlight without seriously impairing the normal use thereof.

A yet further object of my present invention is to provide flashlight holding mouthpieces which are constructed and arranged to prevent the exposure of the user's mouth to the cold metal of a flashlight barrel in conditions of extreme cold.

Another object of my present invention is to provide flashlight holding mouthpieces which are easily affixed to flashlights and yet cannot easily be accidentally detached from said flashlights.

Other objects of my present invention will in part be obvious and will in part appear hereinafter.

My present invention, accordingly, comprises the articles embodying the features of construction exemplified in the following disclosure, and the scope of my present invention will be indicated in the claims appended hereto.

In accordance with a principal feature of my present invention flashlight holding mouthpieces are disclosed which are formed from a single piece of soft, elastic material.

In accordance with another principal feature of my present invention each flashlight holding mouthpiece thereof is comprised of a receptacle portion adapted to receive and tight-fittingly embrace one end of the barrel of a flashlight, and a flange portion surrounding the open end of said receptacle portion and projecting radially outwardly therefrom.

In accordance with a yet further principal feature of my present invention the peripheries of the flange portions of certain ones of the flashlight holding mouthpieces thereof are comprised of first and second longer portions which are curvilinear and are concave toward the barrel of the associated flashlight and first and second shorter portions which are curvilinear and are concave toward the barrel of the associated flashlight.

In accordance with another principal feature of my present invention the peripheries of the flange portions of certain ones of the flashlight holding mouthpieces thereof are generally elliptical in shape and the flange portions thereof are concave toward the end of the barrel of the associated flashlight which is remote from the light producing end of the associated flashlight.

For a fuller understanding of the nature and objects of my present invention, reference should be had to the following detailed description, taken in connection with the accompanying drawings.

DESCRIPTION OF THE PREFERRED EMBODIMENTS

Figure 1:
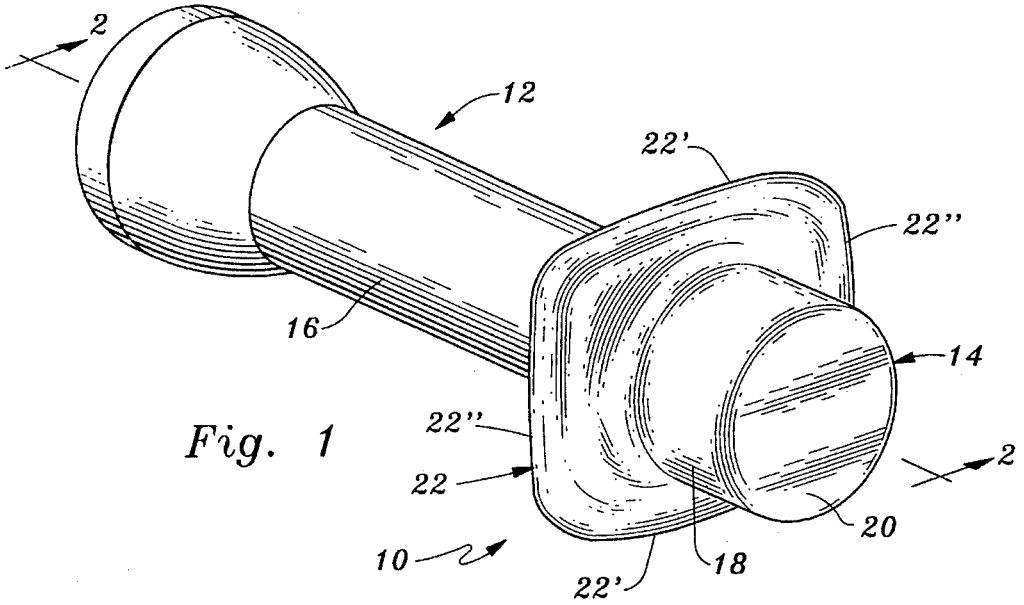
FIG. 1 is a perspective view of a miniature flashlight equipped with a flashlight holding mouthpiece of the first preferred embodiment, of my present invention.

Referring now to FIGS. 1 through 4, there is shown a flashlight holding mouthpiece 10 of the first preferred embodiment of my present invention, installed on a conventional miniature flashlight 12.

As may be seen by comparison of FIGS. 1 through 4, mouthpiece 10 is a unitary body of soft, elastic material, which is comprised of a cup-shaped receptacle portion 14.

Receptacle portion 14 is constructed and arranged to receive and grippingly engage the rearward end of the barrel 16 of miniature flashlight 12.

Figure 2:
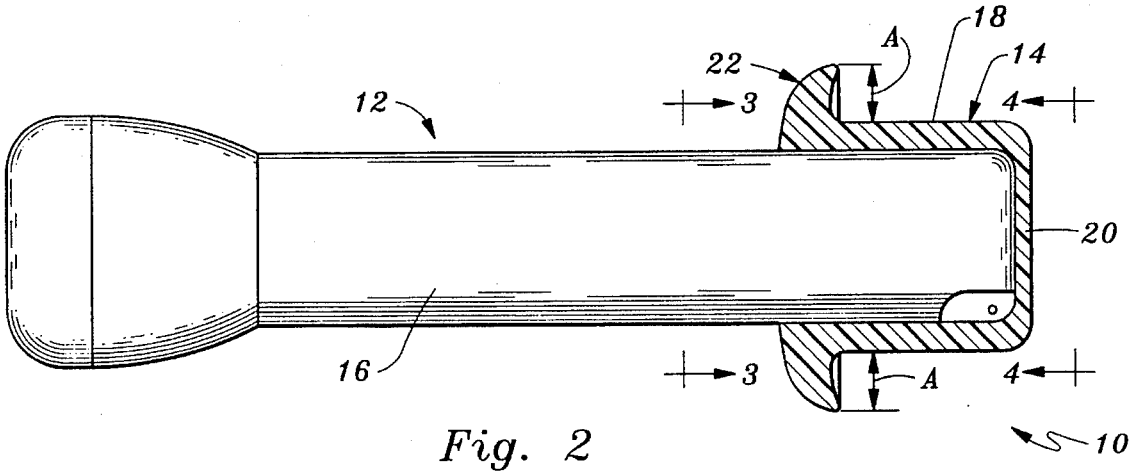
FIG. 2 is an elevational view, partly in section, of the flashlight and flashlight holding mouthpiece of my present invention shown in FIG. 1, taken on plane 2—2 of FIG. 1.

As best seen in FIG. 2, receptacle portion 14 of mouthpiece 10 is comprised of a generally cylindrical wall portion 18 and an end (or floor) portion 20.

Mouthpiece 10 is further comprised of a flange portion 22 which surrounds the mouth or open end of receptacle portion 14 and projects radially outwardly therefrom.

Figure 3:
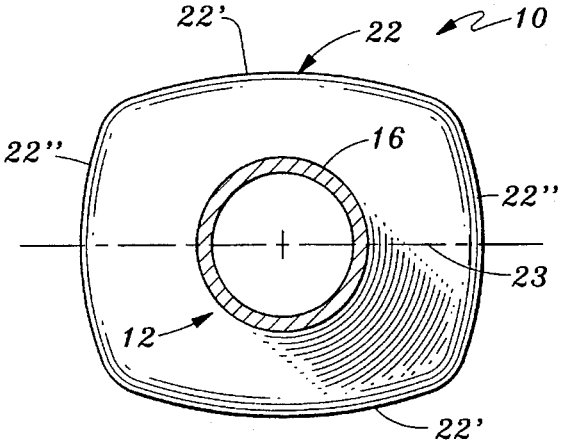
FIG. 3 is a cross-sectional view of the flashlight and flashlight holding mouthpiece of my present invention shown in FIGS. 1 and 2, taken on plane 3—3 of FIG. 2.
Figure 4:
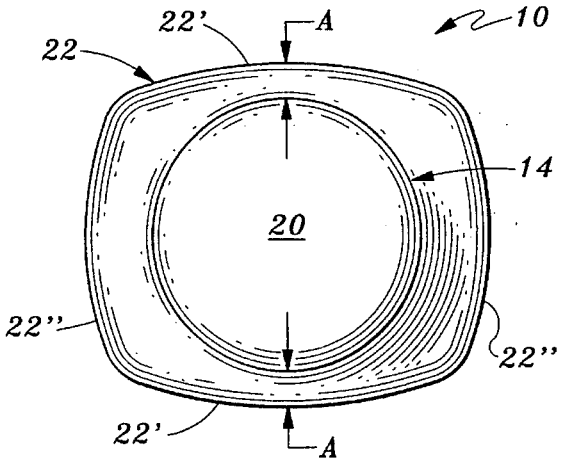
FIG. 4 is a cross-sectional view of the flashlight and flashlight holding mouthpiece of my present invention shown in FIGS. 1 and 2, taken on plane 4—4 of FIG. 2.

Referring now to FIGS. 1, 3 and 4, it will be seen that flange portion 22 is not circular, but rather has two longer edges. 22' and two shorter edges 22".

It will further be seen in FIG. 2 that the minimum distance A between the outer surface of cylindrical portion 14 and the periphery of flange 22 is less than twice the thickness of wall portion 18.

Thus, as will be evident to those having ordinary skill in the art, informed by the present disclosure, the minimum distance A is such that flange portion 22 may lie between the user's teeth and lips when flashlight 12 is held in the user's mouth with the aid of mouthpiece 10 of the first preferred embodiment of my present invention, in which case the major axis 23 of flange 22 (FIG. 3) will be substantially parallel to the major dimension of the user's mouth (horizontal) and consequently flashlight 12 will be prevented from rolling or rotating between the user's teeth.

Referring now to FIGS. 5 through 8, there is shown a flashlight holding mouthpiece 30 of the second preferred embodiment of my present invention, installed on a conventional miniature flashlight 32.

As may be seen by comparison of FIGS. 5 through 8, mouthpiece 30 is a unitary body of soft, elastic material which is comprised of a cup-shaped receptacle portion 34 constructed and arranged to receive and grippingly engage the rearward end of barrel 36 of miniature flashlight 32.

Figure 6:
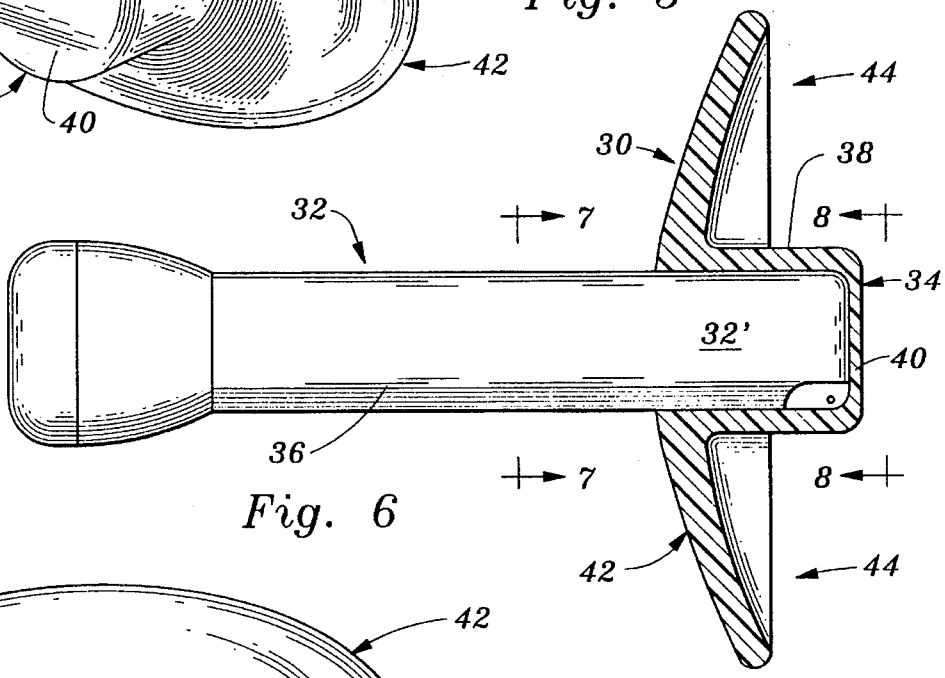
FIG. 6 is an elevational view, partly in section, of the flashlight and flashlight holding mouthpiece of my present invention shown in FIG. 5, taken on plane 6—6 of FIG. 5.

As best seen in FIG. 6, receptacle portion 34 of mouthpiece 30 is comprised of a generally cylindrical wall portion 38 and an end (or floor) portion 40.

Mouthpiece 30 is further comprised of a flange portion 42 which surrounds the mouth or open end of receptacle portion 34 and projects outwardly therefrom.

It is also to be noted that the flange portion 42 of the mouthpiece 30 of the second preferred embodiment of my present invention projects outwardly from the outer surface of cylindrical portion 38 much further than flange 22 of the first preferred embodiment of my present invention projects outwardly from the outer surface of cylindrical portion 18 of the mouthpiece 10 of the first preferred embodiment.

Thus, it will be seen that while in using mouthpiece 10 of the first preferred embodiment of my invention flange portion 22 may lie between the user's teeth and lips, flange portion 42 of the second preferred embodiment of my invention (FIGS. 5 through 8) is so relatively large that when the mouthpiece 30 of the second preferred embodiment of my invention is in use the user's teeth and lips necessarily lie behind flange portion 42, and thus the user's lips are protected from contact with the metal barrel 36 of flashlight 32, and the user is protected in extremely cold environments from great discomfort or even injury by way of the user's lips freezing to metallic flashlight barrel 36.

Figure 5:
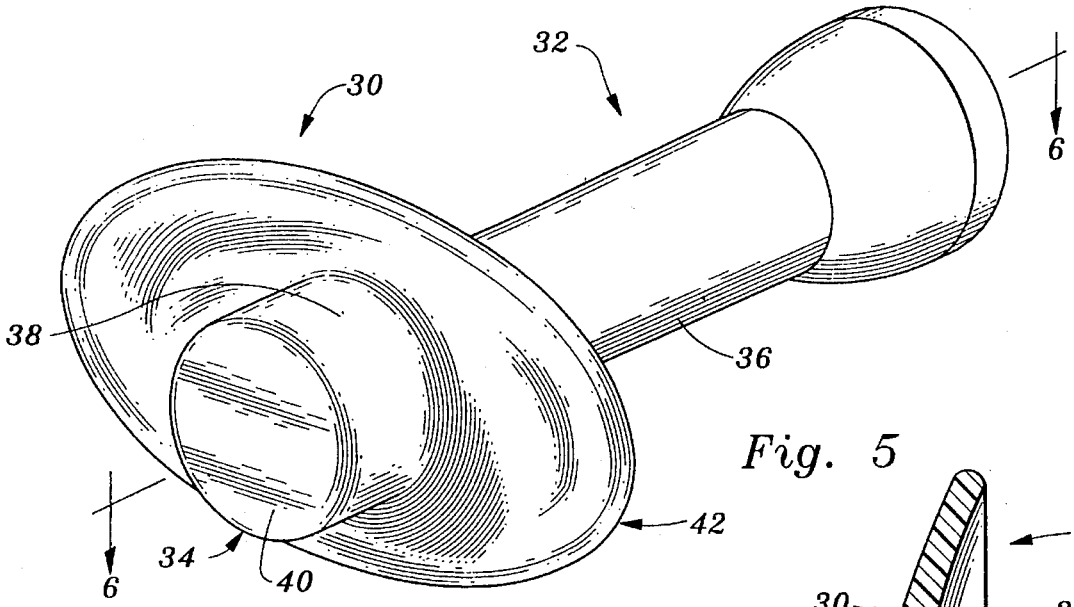
FIG. 5 is a perspective view of a miniature flashlight, equipped with a flashlight holding mouthpiece of the second preferred embodiment of my present invention.
Figure 7:
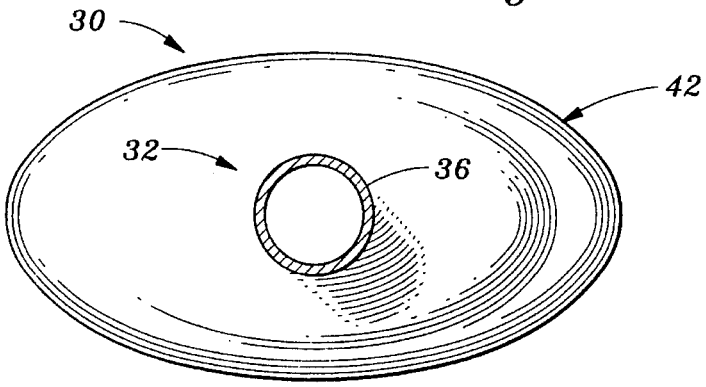
FIG. 7 is a cross-sectional view of the flashlight and flashlight holding mouthpiece of my present invention shown in FIGS. 5 and 6, taken on plane 7—7 of FIG. 6.
Figure 8:
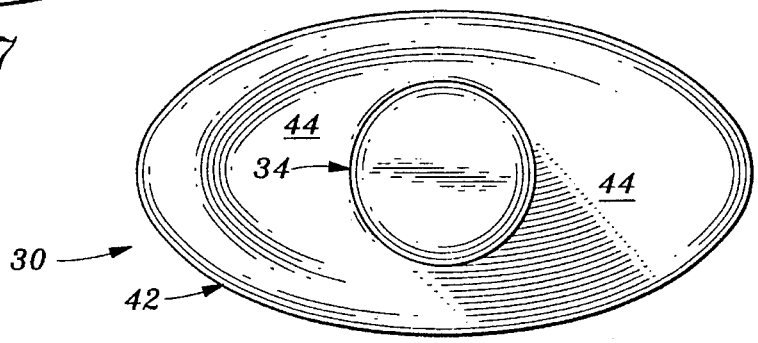
FIG. 8 is a cross-sectional view of the flashlight and flashlight holding mouthpiece of my present invention shown in FIGS. 5 and 6, taken on plane 8—8 of FIG. 6.

As may be seen by comparison of FIGS. 5, 7 and 8, flange portion 42 of the second preferred embodiment of my invention is elongated in shape.

Further, as seen in FIG. 6, flange 42 defines a concavity 44 which opens toward the rear end (32', FIG. 6) of flashlight barrel 36.

As may be seen by comparison of FIGS. 6 and 8, concavity 44 extends completely around receptacle 34.

Thus, it will be seen by those having ordinary skill in the art, informed by the present disclosure, that mouthpiece 30 of the second preferred embodiment of my invention is so shaped that when mouthpiece 30 is in use concavity 44 generally embraces the user's lips and prevents mouthpiece 30, and flashlight 32, from rotating with respect to the major dimension of the user's mouth.

It will thus be seen that the objects set forth above, among those made apparent from the preceding description, are efficiently attained, and since certain changes may be made in the features of constructions, combinations of elements, and arrangements of parts described hereinabove without departing from the scope of my present invention, it is intended that all matter contained in the above description or shown in the accompanying drawings shall be interpreted as illustrative only, and not in a limiting sense.

It is also to be understood that the following claims are, intended to cover all of the generic and specific features of my invention hereindescribed, and all statements of the scope of my invention which, as a matter of language, might be said to fall therebetween.

What is claimed is:

1. A flashlight holding mouthpiece adapted to be affixed to a miniature flashlight by frictionally gripping engagement therewith, and to be gripped between upper and lower teeth of a user of said flashlight, said flashlight being comprised of a cylindrical barrel portion having a light-emitting end and an opposite end, said mouthpiece comprising:

a receptacle portion having a closed end and an open end defining a cavity adapted to receive said opposite end of said barrel portion of said flashlight, said receptacle portion tight-fittingly frictionally engaging said opposite end of said barrel portion of said flashlight and being configured to be gripped between said teeth of said user in such manner that a part of said opposite end of said barrel portion is disposed between said upper and lower teeth of said user;

a flange portion joined to said open end of said receptacle portion and projecting outwardly therefrom.

2. A flashlight holding mouthpiece as claimed in claim 1 in which said receptacle portion and said flange portion are parts of a single body of soft, elastic material.

3. A flashlight holding mouthpiece adapted to be affixed to a miniature flashlight by frictionally gripping engagement therewith, and to be gripped between upper and lower teeth of a user of said flashlight, said flashlight being comprised of a cylindrical barrel portion having a light-emitting end and an opposite end, said mouthpiece comprising:

a receptacle portion adapted to receive and tight-fittingly engage said opposite end of said barrel portion of said flashlight and having a closed end and an open end defining a cavity adapted to receive said opposite end of said barrel portion of said flashlight; and a flange portion joined to said receptacle portion at said open end thereof and projecting outwardly from said receptacle portion;

said receptacle portion and said flange portion being parts of a single body of soft, elastic material; and the periphery of said flange portion being oblong and said flange portion being so dimensioned as to fit between said user's lips and said user's teeth wherein said receptacle portion is gripped between upper and lower teeth of said user.

4. A flashlight holding mouthpiece adapted to be affixed to a miniature flashlight by frictionally gripping engagement therewith, and to be gripped between upper and lower teeth of a user of said flashlight, said flashlight being comprised of a cylindrical barrel portion having a light-emitting end and an opposite end, said mouthpiece comprising:

a receptacle portion adapted to receive and tight-fittingly engage said opposite end of said barrel portion of said flashlight and having an open end adapted to receive said opposite end of said barrel portion of said flashlight; and a flange portion joined to said receptacle portion at said open end thereof and projecting outwardly from said receptacle portion;

said receptacle portion and said flange portion being parts of a single body of soft, elastic material; and the periphery of said flange portion being oblong, said flange portion including a concavity which opens toward said opposite end of said barrel portion of said flashlight received in said receptacle portion, and said flange portion being large enough in area so that said concavity embraces a portion of said user's face surrounding said user's mouth wherein some of said user's teeth are grippingly engaged with said receptacle portion, whereby to prevent said user's lips from contacting said barrel of said miniature flashlight.

* * * * *